US005556244A

United States Patent [19]

Begemann et al.

[11] Patent Number: 5,556,244

[45] Date of Patent: Sep. 17, 1996

[54] METHOD OF AND APPARATUS FOR BACKING BOOK BLOCKS

[75] Inventors: Kurt Begemann, Lohne; Horst Rathert, Minden; Manfred Albrecht, Lubbecke, all of Germany

[73] Assignee: Kolbus GmbH & Co. KG, Rahden, Germany

[21] Appl. No.: 402,716

[22] Filed: Mar. 13, 1995

[30] Foreign Application Priority Data

Mar. 18, 1994 [DE] Germany ..... 44 09 319.5

[51] Int. Cl.[6] ..... B42C 5/02

[52] U.S. Cl. ..... 412/30

[58] Field of Search ..... 412/22, 25, 29, 412/30

[56] References Cited

U.S. PATENT DOCUMENTS

| | | | |
|---|---|---|---|
| 3,413,669 | 12/1968 | Thorp | 412/30 |
| 4,747,740 | 5/1988 | Rate | 412/30 |
| 5,104,275 | 4/1992 | Rathert | 412/30 |

FOREIGN PATENT DOCUMENTS

| | | | |
|---|---|---|---|
| 1536507 | 6/1967 | Germany . | |
| 8128207U1 | 9/1981 | Germany . | |
| 3614168A1 | 4/1986 | Germany . | |
| 4005949A1 | 2/1990 | Germany . | |
| 0827324 | 5/1979 | U.S.S.R. | 412/30 |

*Primary Examiner*—Willmon Fridie, Jr.
*Attorney, Agent, or Firm*—Chilton, Alix & Van Kirk

[57] ABSTRACT

The backing of a previously rounded book block is accomplished, while the book block is clamped between oppositely disposed gripping jaws, by subjecting the spine region of the book block to composite forces resulting from imparting a swinging motion along an arcuate path to a pressing beam carrier, to cause the pressing beam to bend the book block sheets outwardly away from the center line of the block, and superimposing tangential sliding motion on the pressing beam as it acts on the book block in the region adjacent the edges of the spine to thereby controllably form creases in the opposite sides of the block.

27 Claims, 7 Drawing Sheets

METHOD OF AND APPARATUS FOR BACKING BOOK BLOCKS

BACKGROUND OF THE INVENTION

1. Field of the Invention

The present invention relates to the procedure, practiced in the course of the commercial manufacture of a book, known as "backing" the book block and, particularly, to the processing of a previously rounded book block to shape the spine region thereof so as to place it in condition to receive a cover. More specifically, this invention is directed to apparatus for imparting the requisite shape to the spine of a book block in order to prepare the book block for the application of a cover thereto and, especially, to apparatus which forms a pair of creases in the opposite sides of a clamped, previously rounded book block adjacent to the spine thereof. Accordingly, the general objects of the present invention are to provide novel and improved methods and apparatus of such character.

2. Description of the Prior Art

In the production of a book, prior to the application of a cover thereto, it is known to sequentially round and back the stack of ordered sheets which define the book block. The backing operation is conventionally performed with the use of a shaped part that is caused to move backwards and forwards over the entire breadth of the book block spine. As a result of the friction and application of pressure which accompanies these movements, the edge regions of the sheets comprising the book block are folded away from the center of the book block spine, i.e., the sheets comprising the book block are bent outwardly generally in the direction of the two opposite sides of the block. The angles through which the printed sheets are folded increase in the outward direction from the book block center. The net result is the imparting of a stable, mushroom-like shaped spine region to the book block.

An example of a prior art book rounding and backing machine of the type generally discussed above is disclosed in published German Application 1,536,507.

The curvature of the traditional rounded shape of the spine region of a book block will vary from book-to-book, i.e., there are a multiplicity of radii of curvature which must be accommodated by a book manufacturer. In order to reliably achieve the requisite shape, there must be a matching of the book contacting member(s) of the backing apparatus, i.e., the pressing beam(s), to the desired spine radius. However, bearing in mind that there are a multiplicity of radii, this matching is feasible only within narrow limits. Restated, taking into account the economic and physical constraints which limit the number of parts which may held in inventory, and further taking into account the relatively long set-up time of the prior art backing machines, the choice of pressing beam shape has in the past always been a compromise. When there is a comparatively gross mismatch between the shape of the pressing beam and the spine radius, there is an inherent risk of degradation of the quality of the product. This is particularly true in the case of book blocks comprised of sheets having a low flexural stiffness and/or in the situation where the book block to be subjected to the backing operation has not been backlined, i.e., a book block which simply has had an adhesive applied in the spine region and which thus exhibits a high coefficient of friction. The degradation results from the fact that, as the pressing beam executes its return movement to the center of the book block, the printed sheets, which have been bent over towards the sides of the block during the working stroke, will be dragged back with the tool. Such bending followed by a dragging back can lead to the "collapse" of the creased sheets.

SUMMARY OF THE INVENTION

The present invention overcomes the above-briefly discussed and other deficiencies and disadvantages of the prior art by means of a novel and improved technique which reliably imparts the desired generally mushroom-like spine shape to a previously rounded book block. The invention also encompasses apparatus for practicing this technique through the exercise of control over the motion of a pressing beam.

Apparatus in accordance with the invention includes a load-bearing member having an associated carrier which, in turn, supports the pressing beam. The carrier is moveable relative to the load-bearing member and is caused to execute swinging movements while the pressing beam applies a compressive force to the book block spine. These swinging movements are constrained to be along arcuate paths and result in the pressing beam moving from the center to one side of the book block while applying force thereto, executing a return stroke to the center and then moving to the other side of the book block while force is applied to the block. During these swinging movements, as a result of cooperation between the pressing beam and the jaws in which the block is clamped, the printed sheets comprising the book block will be bent over in the side regions of the book block spine. In accordance with the invention, the pressing beam is laterally displaced relative to the plane defined by the book block center line so as to generate a tangential "sliding" movement of the pressing beam in the side regions of the book block spine. This tangential sliding movement is superimposed on the swinging movement and results in the formation of either a deep-joint crease or a low-angle joint crease as desired.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENTS

Figure 1:
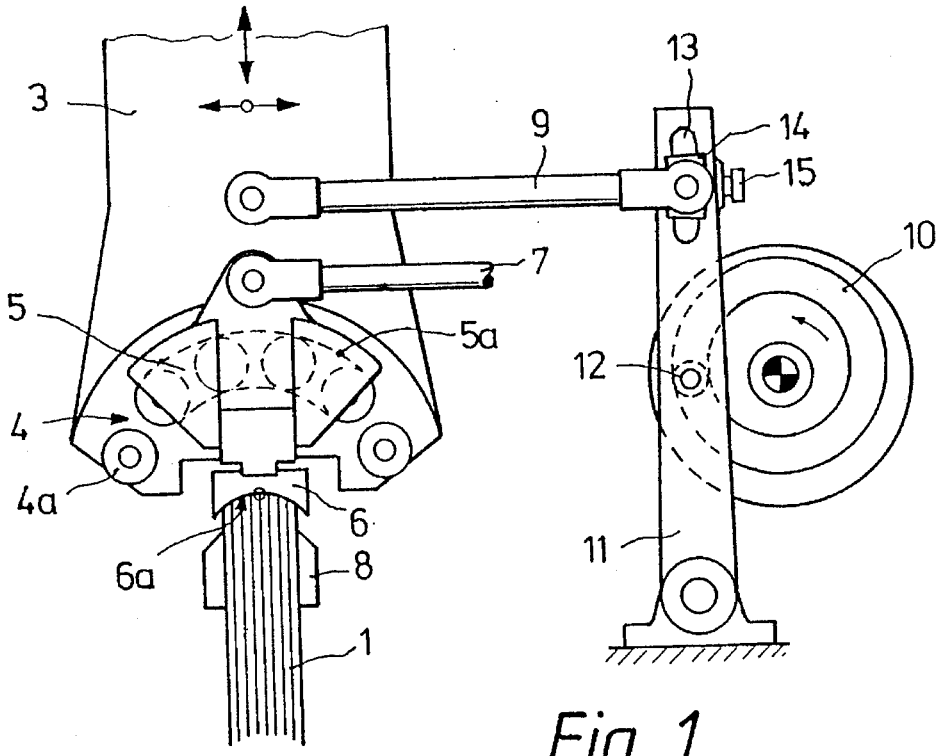
FIG. 1 is a schematic, side-elevation view of apparatus for backing book blocks in accordance with a first embodiment of the invention, the apparatus being shown at the beginning of the backing process.
Figure 2:
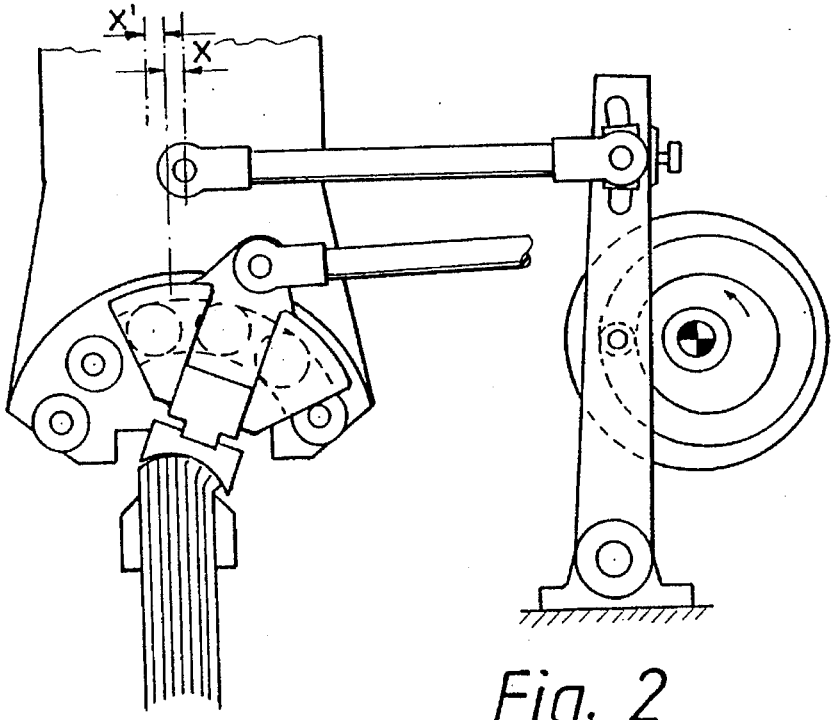
FIG. 2 is a view similar to FIG. 1 depicting the apparatus of FIG. 1 during execution of the book block spine shaping operation.

With reference to FIGS. 1 and 2, a book block to be shaped is indicated at 1. Book block 1 is typically comprised of a plurality of folded, printed sheets which have been stacked in the proper order. Book block 1 is received at the backing station, from an upstream rounding station where the spine region thereof is given a curvature, firmly held between gripping jaws 8. The apparatus at the backing station generally comprises a load-bearing component or press 3, a bridge or carrier 5 and a pressing beam 6. The load-bearing component 3 has a pair of integral, spaced projecting brackets. Freely rotatable rollers 4*a* are mounted on these brackets and are located so as to describe an arc. The carrier 5 is provided with an arc-shaped track 5*a* which is engaged by rollers 4*a* and track 5*a*. Accordingly, the rollers 4*a* define a movement path, indicated generally at 4, for the carrier 5 relative to the load-bearing component 3. The movements of the carrier 5 along path 4, produced in the manner to be described below, thus result in a component of movement of the carrier 5 relative to the load-bearing component 3. In the embodiment of FIGS. 1 and 2 the pressing beam 6 is rigidly coupled to the carrier 5 and thus movements of the carrier are directly translated into movements of the pressing beam. The pressing beam 6 is depicted as having a concave working surface 6*a* which is approximately complementary to the spine shape of the rounded book block 1.

The carrier 5, with pressing beam 6, is caused to execute swinging movements about the mid-point of path 4, these movements being generated by a main drive system, not shown, and being transmitted to carrier 5 via an actuating rod 7. As may be seen from the drawings, actuating rod 7 is coupled to carrier 5 via a pivot joint. The compressive force imparted to the book block 1 by pressing beam 6 as a result of the relative swinging movement between carrier 5 and pressing beam 3 starts from the point of contact between the center point of the pressing beam and the center line of the book block spine and progress first to one side of the spine and then, in turn, to the other side. In the embodiment of FIGS. 1 and 2, the pressing beam 6 executes these movements to the right, as shown in FIG. 2, and then to the left, i.e., the pressing beam rotates clockwise and then counterclockwise.

During the times the pressing beam is rotating outwardly, i.e., moving from the position of FIG. 1 toward that of FIG. 2, a compressive force is applied to the block. This compressive force is produced by drive means, not shown, which acts on the load-bearing component 3. The applied compressive force causes the pressing beam to apply a defined pressing force to the rounded spine of the book block 1.

In accordance with the invention, in order to ensure that the printed sheets in the side regions of the book block spine will be bent over to define the requisite oppositely disposed creases, a component of motion is imparted to the pressing beam 6 in a direction which is generally tangential to the above-described swinging motion. This tangential movement, i.e., motion of pressing beam 6 tangent to the curve of its working surface 6*a*, is superimposed on the motion resulting from the swinging movement of carrier 5. The tangential movement is produced by causing displacement of a defined magnitude of the load-bearing component 3 relative to a vertical plane in which the center line of the book block 1 lies. The displacement of load-bearing component 3 results from movements imparted thereto via a coupling rod 9. Referring to FIG. 2, the load-bearing component 3 is caused to move first to the right, through a distance x, and then, in turn, to the left of the plane of the center line of the book block through the distance x'. These side-to-side movements are generated by means of a cam 10, rotated by drive means which is not shown in the drawing, and are transmitted to coupling rod 9 via a roller 12 mounted on a pivoted actuating arm 11.

The controlled magnitude of the tangential movement, i.e., the distance x toward one side and x' toward the other side of the book block, allows for the widening of the book block spine in the course of the backing operation. It should be noted, however, that the distance by which the pressing beam 6 overhangs the book block 1 remains constant, i.e., there is no actual relative movement between the center line of the pressing beam 6 and the spine portion of the book block 1 which is contacted thereby. Thus, the above-described movements are converted into distortion of the sheets comprising the spine portion of the clamped book block as shown in FIG. 2. The tangential movement may, nevertheless, be considered to be a sliding movement relative to that portion of the book block which is disposed between or below clamp jaws 8.

The sliding tangential movement that is superimposed on the swinging or rotational movement of the pressing beam can be varied to suit the book block spine shape that is desired, depending on the book block thickness, the shape of the working surface 6*a* of the pressing beam 6 and the position of the center of rotation of the pressing beam. These adjustments are accomplished in the embodiment being described, by altering the position of the point at which coupling rod 9 is pivotally connected to actuating arm 11. These position alterations are implemented by adjusting elements in the form of an elongated, arcuate slot 13 in arm 11, a slidable block 14 which engages the slot 13 and the rod 9, and a clamping screw 15.

The return strokes of pressing beam 6 take place generally along the same movement path as the strokes which produce the shaping of the block. However, during the movements of the pressing beam from its most outwardly rotated position (see FIG. 2) to the central or starting position (see FIG. 1 ), the pressing beam 6 is advantageously caused to execute a very small vertical movement to relieve the compressive force applied to the book block by the pressing beam. This vertical movement will be diminished to zero, i.e., the condition of FIG. 1 will be reestablished, by the time the pressing beam reaches its central position.

Figure 3:
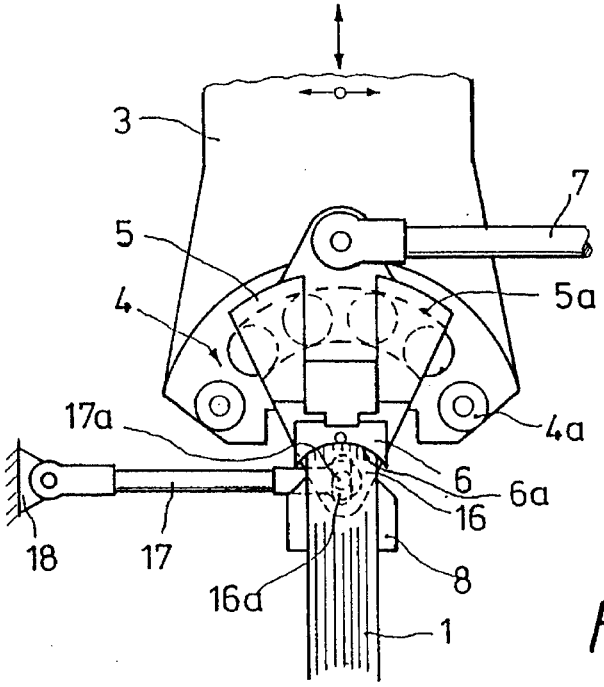
FIG. 3 is a schematic, side-elevation view of backing apparatus in accordance with a second embodiment of the invention, the apparatus being shown at the beginning of the backing process.
Figure 4:
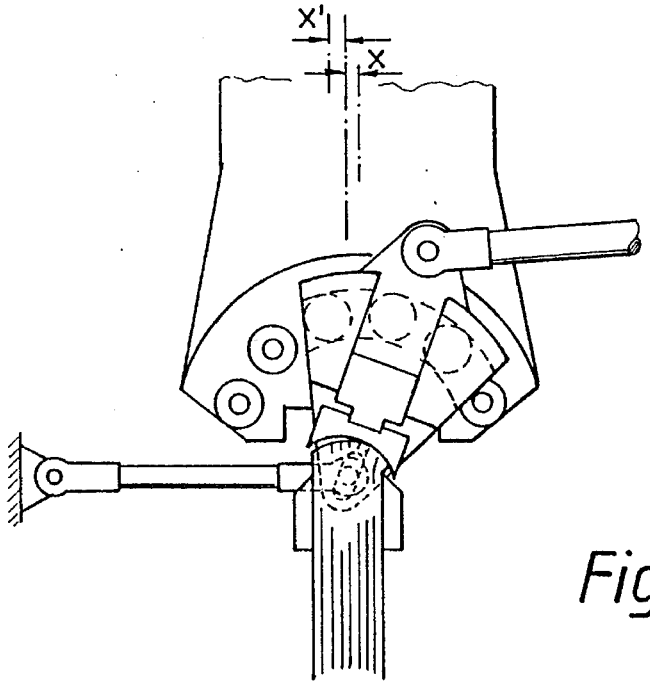
FIG. 4 is a view similar to FIG. 3 depicting the apparatus of FIG. 1 during execution of the book block spine shaping operation.

Referring now to FIGS. 3 and 4, a modification of the embodiment of FIG. 1 is shown. In the embodiment of FIGS. 3 and 4, as will be described below, the displacement of the load-bearing component 3 to opposite sides of the plane of the center line of the book block is produced by a force transmitted to the load-bearing component through the carrier member 5. Thus, a coupling rod 17 extends from a fixed bearing point 18 to a lever arm 16. Lever arm 16 may be formed by a projecting portion of the carrier member 5. The connection point of rod 17 and lever 16 is located below a notational center of rotation of pressing beam 6.

Figure 3A:
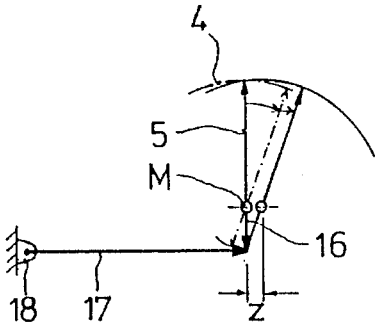
FIG. 3*a* is a diagramatic showing which explains the operation of the apparatus of FIG. 3.

Referring to FIG. 3*a*, in order to prevent a sliding movement from being applied to the book block spine as the swinging motion of the carrier 5 begins, the center of rotation "M" of the pressing beam 6 is adjusted to a position above the book block spine. The magnitude of the sliding stroke "Z" can be set by varying the effective length of the lever arm 16. This is accomplished by making the point at which lever arm 16 is connected to coupling rod 17 adjustable. Such an adjusting means is schematically illustrated in FIG. 3 at 16*a*. In FIG. 3*a* the broken line curve represents the displacement of load bearing component 3 and, as shown, the radius of this curve is the same as the radius of path 4. In the embodiment of FIGS. 3 and 4, the return stroke of pressing beam 6, as in the case of the above-described embodiment, takes place generally along the same movement path as the working stroke, but advantageously after the execution of a very small vertical movement of the load-bearing component 3. Alternatively, the fixed bearing point 18 can be caused to shift upwardly during the return of the pressing beam 6 to the central position.

Figure 5:
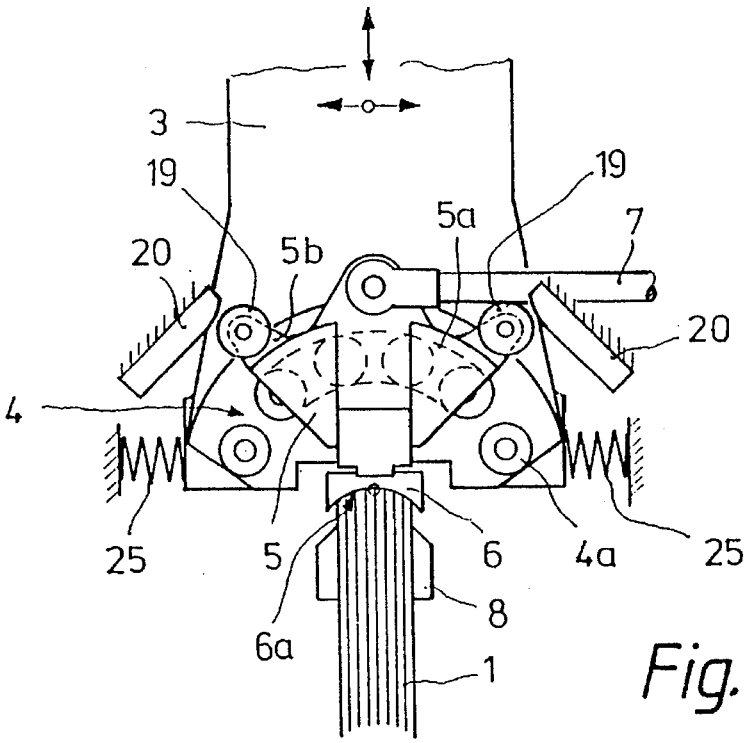
FIG. 5 is a schematic, side-elevation view of apparatus for backing book blocks in accordance with a third embodiment of the invention, the apparatus being shown at the beginning of the backing process.
Figure 6:
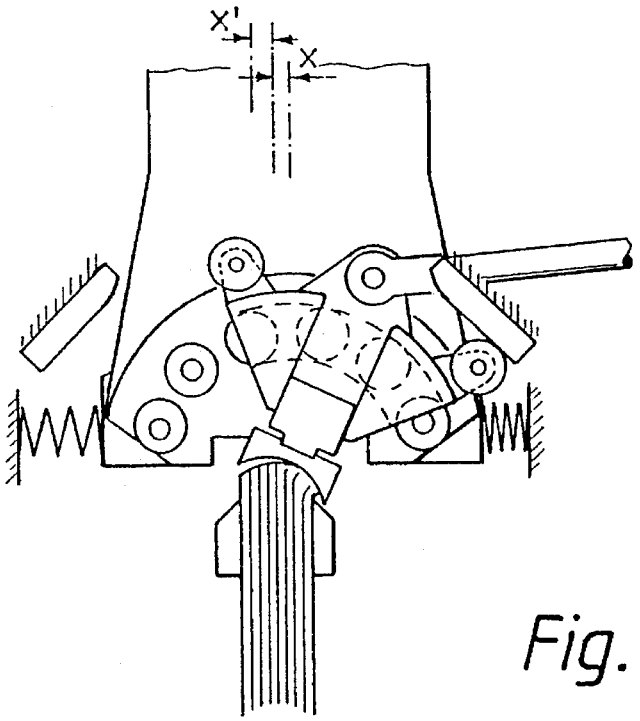
FIG. 6 is a view similar to FIG. 5 depicting the apparatus of FIG. 5 during execution of the book block spine shaping operation.

FIGS. 5 and 6 depict a third embodiment of the invention which is a further modification of the apparatus of FIGS. 1 and 2. In the embodiment of FIGS. 5 and 6 the tangential sliding movement, i.e., the lateral displacement of load-bearing component 3, is produced by cooperation between control rollers 19 and fixed position control tracks 20. The control rollers 19 are mounted on lugs 5*b* which project from carrier 5 and contact respective cooperating control tracks 20 during the latter part of the stroke, i.e., the outward swinging motion of carrier 5 and pressing beam 6. The cooperation between the control rollers 19 and control tracks 20 forcibly constrains the carrier and the constraining force is translated into generally horizontal movement of the load-bearing component by the action of tracks 5*a* on rollers 4*a*.

The control tracks 20 are configured such that there will be no contact between a control roller 19 and the cooperating control track at the beginning of the swinging movement, i.e., when the carrier 5 starts to move away from the position shown in FIG. 5. The tangential sliding movement subsequently occurs, and is superimposed on the swinging movement, by cooperation between a roller 19 and the flank of a track 20. During the return stroke of pressing beam 6, only swinging movement will occur until such time as a control roller 19 comes into contact with the flank of the opposite control track 20. This enables a friction-free return stroke to be executed without a vertical movement. In the embodiment of FIGS. 5 and 6, the load-bearing component 3 is resiliently biased to a central position by means of springs 25.

Figure 7:
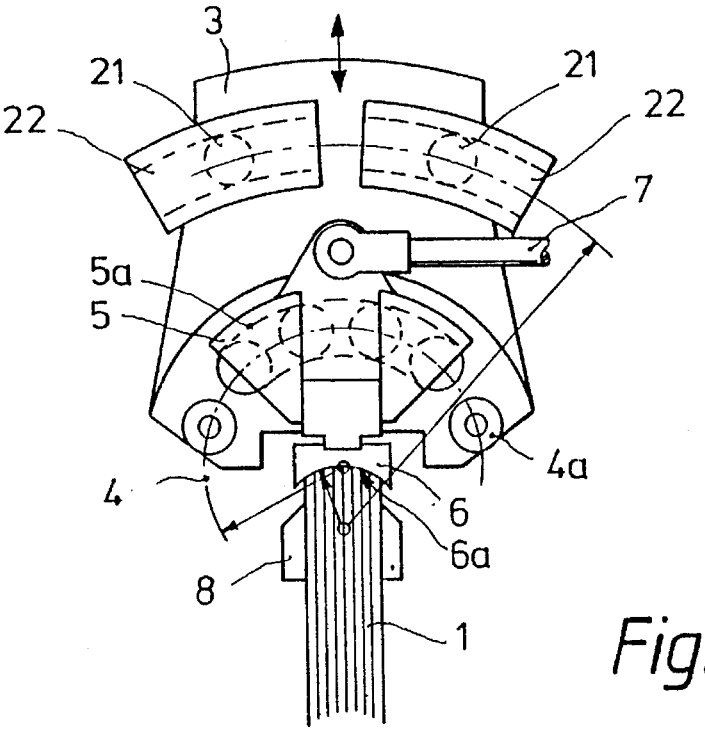
FIG. 7 is a schematic, side-elevation view of apparatus for backing book blocks in accordance with a fourth embodiment of the invention, the apparatus being shown at the beginning of the backing process.
Figure 8:
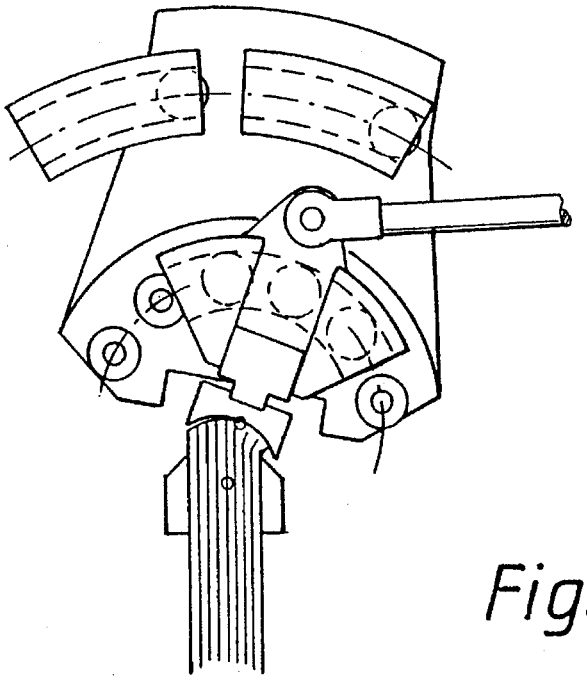
FIG. 8 is a view similar to FIG. 4 depicting the apparatus of FIG. 4 during execution of the book block spine shaping operation.

FIGS. 7 and 8 depict a further embodiment of the invention which is a modification of the embodiment of FIGS. 5 and 6. In the embodiment of FIGS. 7 and 8 the displacement of the load-bearing component 3 is guided on an arc-shaped path by cooperation between rollers 21, mounted on load-bearing component 3 so as to define the path, and track-segments 22 associated with a supporting frame, not shown. Since the apparatus must accommodate pressing beams 6 having working surfaces 6*a* of different radii, means for radial adjustment of the rollers 21 and track-segments 22 will be provided. In this embodiment the movement of actuating rod 7, because of the constrained motion resulting from the cooperation of the rollers 4*a* and 21 with their respective guide tracks, produces the desired compound motion of the pressing beam while a pressing force on the book block spine is generated by actuating means which have not been shown in the drawings, Continuing to discuss the embodiment of FIGS. 7 and 8, the radius of the track-segments 22 and the radius of the pressing-beam working surface 6*a* lie on the same axis, and this axis is located below the center of rotation of pressing beam 6. The center of rotation of beam 6 lies approximately on the center line of the book block spine and at a line of contact between the pressing beam and the book block spine.

In the above-described embodiments, the tangential forces on the book block occur as a result of friction between the pressing beam 6 and the spine of the book block 1 which is held between the gripping jaws 8. These tangential forces result in a tangential sliding movement of the pressing beam relative to the immobilized portion of the book block. This tangential sliding movement is superimposed on the swinging, i.e. rotational movement, of rotational movement of beam 6 resulting in a compound motion of the pressing beam which causes the printed sheets comprising the book block to be bent over the upper edge of a cooperating clamp jaw in the side region of the book block spine.

Figure 9:
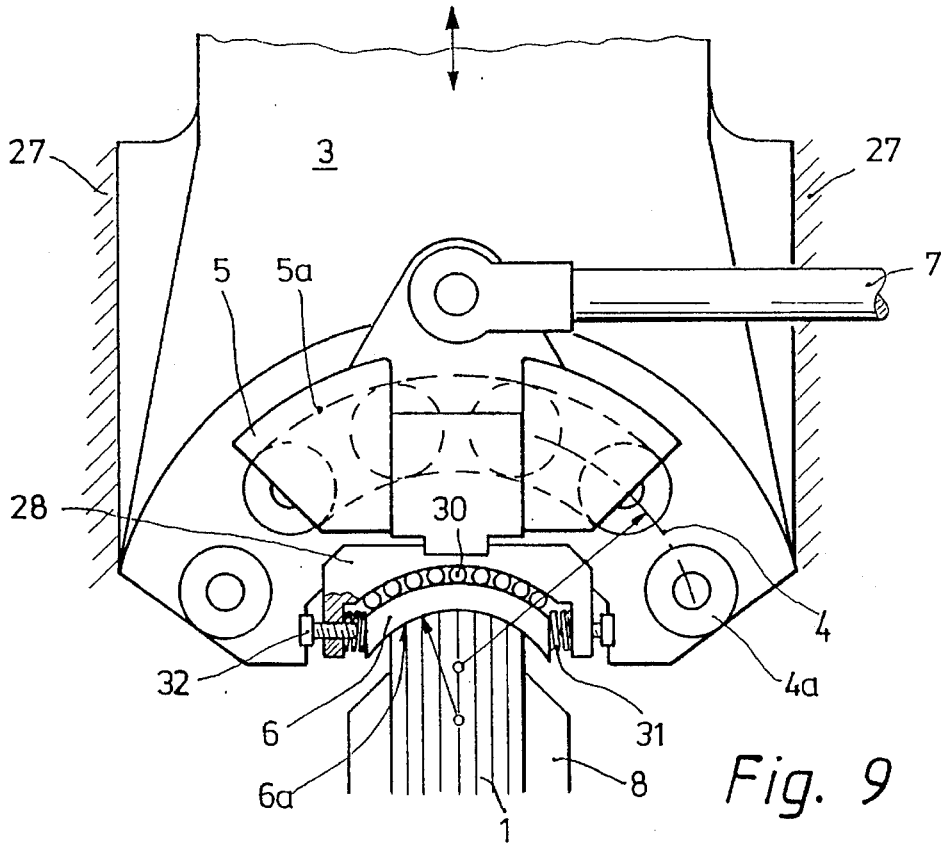
FIG. 9 is a schematic, side-elevation view of apparatus for backing book blocks in accordance with a fifth embodiment of the invention, the apparatus being shown at the beginning of the backing process.
Figure 10:
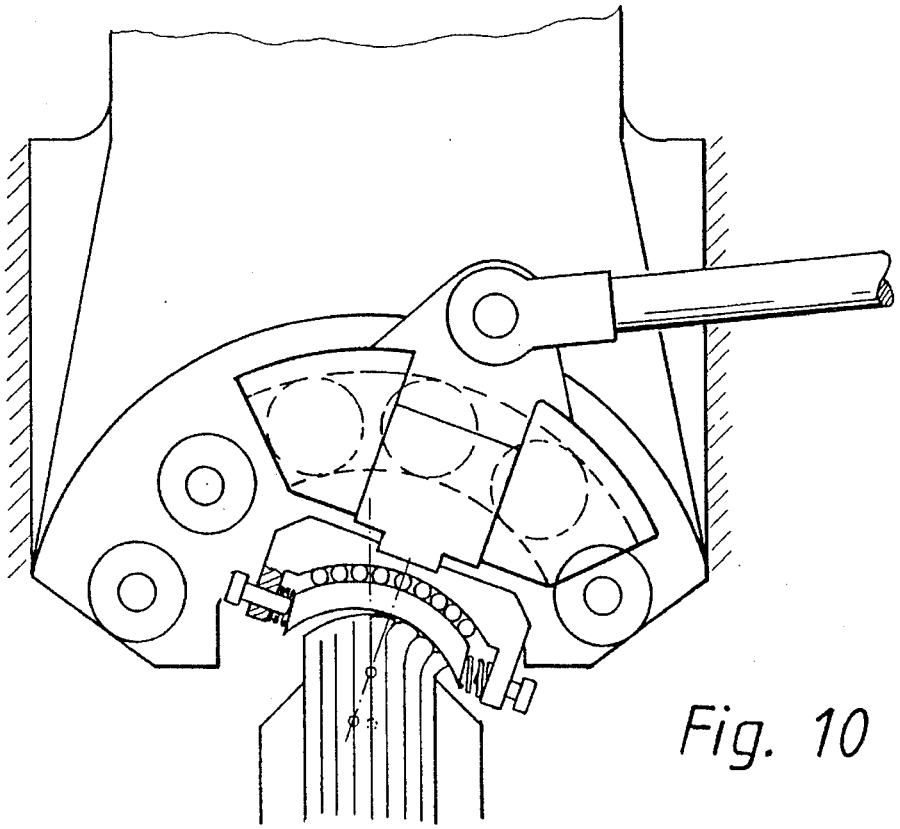
FIG. 10 is a view similar to FIG. 5 depicting the apparatus of FIG. 5 during execution of the book block spine shaping operation.

FIGS. 9 and 10 show another embodiment of the invention. In this embodiment, the load-bearing component 3, with the bridge 5 and pressing beam 6, is vertically movable between fixed lateral guides 27. As in the above-described embodiments, the pressing beam 6 applies a defined pressing force to the previously rounded book block 1, this force being delivered to the load-bearing component 3 by actuating means which have not been shown in the drawings. In the embodiment of FIGS. 9 and 10 the center of rotation of pressing beam 6 is situated a defined distance below its point of contact with the spine of book block 1. This positioning is dictated by the fact that the guides 27 prevent lateral displacement of load-bearing component 3.

As may be seen from FIG. 9, the pressing beam 6 is mounted on rollers 30 concentrically within an intermediate carrier 28. The intermediate carrier 28 is rigidly coupled to carrier 5. Pressing beam 6 is held and centered within the receiving opening provided therefor in intermediate carrier 28 by compression springs 31. Pressing beam 6 is thus free to shift, relative to carrier 5, during the swinging movement of the carrier. The magnitude of the relative motion permitted between pressing beam 6 and intermediate carrier 28 is limited by a pair of adjustable lateral stops 32. The relative shifting motion of pressing beam 6 during the swinging movement of carrier 5 constitutes the tangential sliding movement which is superimposed on the swinging movement of the pressing beam.

Movement of the intermediate carrier 28, with pressing beam 6, is accomplished in the manner described above and causes the pressing beam to execute working strokes such as that which occurs as the pressing beam moves from the position depicted in FIG. 9 to that of FIG. 10. During this motion, as a result of the frictional forces encountered, relative shifting of the pressing beam 6 will occur i.e., one of the springs 31 will be compressed. The magnitude of the distance through which the relative shifting movement occurs can be adjusted by altering the distance between the center of rotation of the pressing beam 6 and the book block spine and also by means of adjusting the lateral stops 32. During the return stroke, i.e., as the pressing beam moves from the position of FIG. 10 back to the position of FIG. 9, a dragging-back of the bent over printed sheets will not occur because of the action of the centering springs 31. Accordingly, in the embodiment of FIGS. 9 and 10, vertical movement of the pressing beam during the return stroke is unnecessary to obtain the relief of the compressive force applied to the book block.

Figure 11:
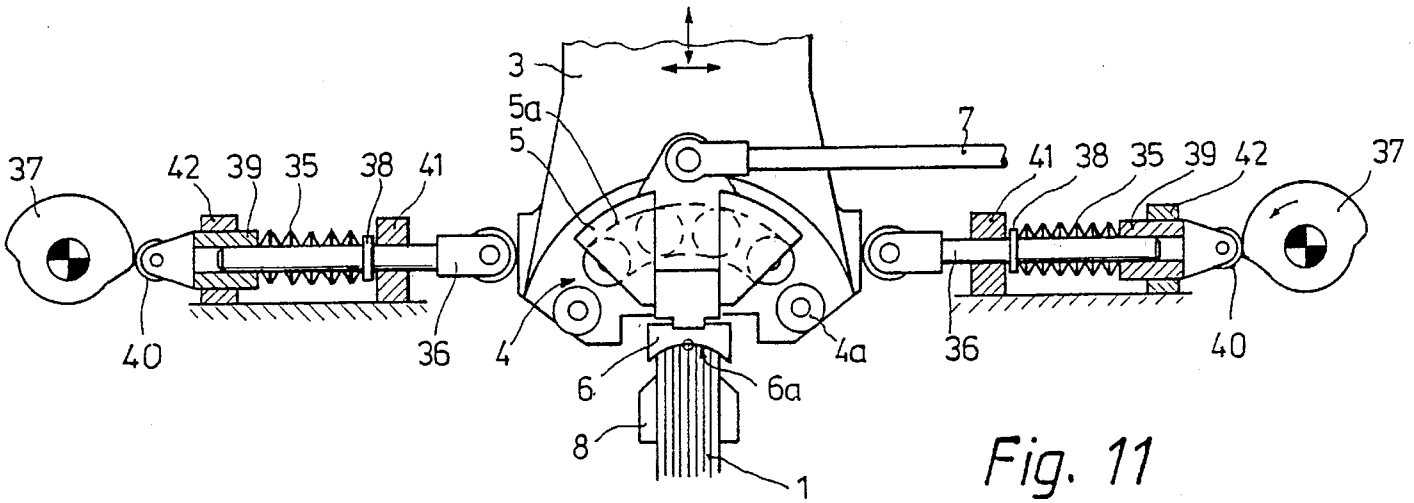
FIG. 11 is a schematic, side-elevation view of apparatus for backing book blocks in accordance with a sixth embodiment of the invention, the apparatus being shown at the beginning of the backing process.
Figure 12:
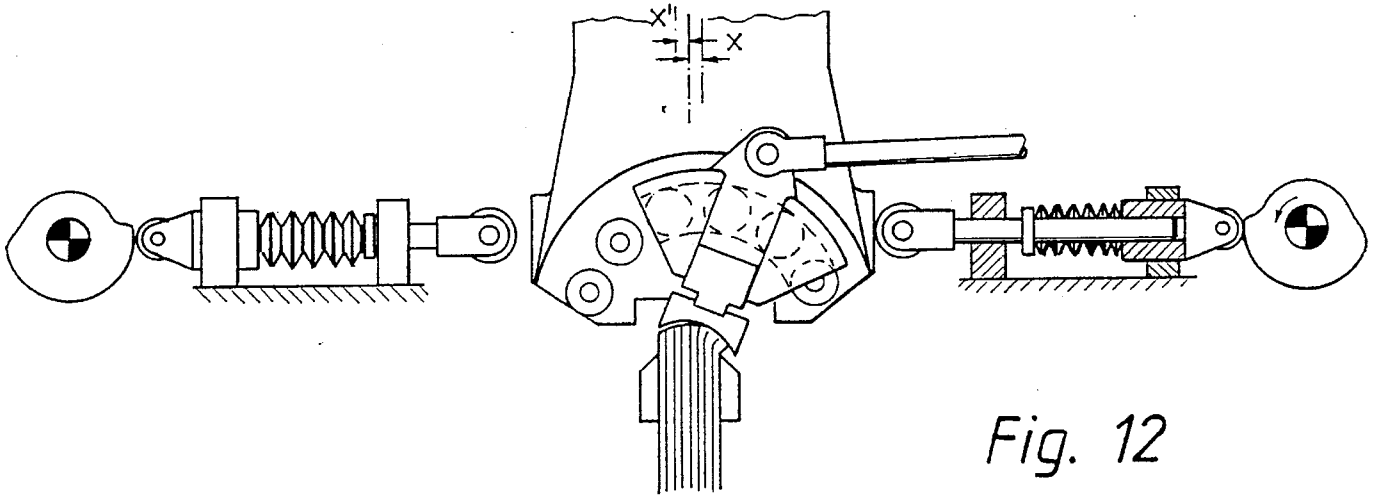
FIG. 12 is a view similar to FIG. 6 depicting the apparatus of FIG. 6 during execution of the book block spine shaping operation.

Another embodiment of the invention, wherein the load-bearing component of the backing apparatus is laterally supported, is shown in FIGS. 11 and 12. In this embodiment, a pair of control assemblies generate a pressing force for bending of the printed sheets of the book block 1 in the side regions of the spine. In the arrangement of FIGS. 11 and 12, the center of rotation of pressing beam 6 is situated at its point of contact with the book block spine.

In operation of the embodiment of FIGS. 11 and 12, the pressing action generated by the control assemblies will be relieved during the return stroke of the pressing beam 6 to its central position thereby preventing the outer printed sheets, which have been bent over toward the sides of the book block, from being dragged back toward their initial unbent position with the pressing beam. Upon relief of the pressing action of the control assemblies, the pressing beam 6 can be raised away from the book block spine during its return stroke.

As may be seen from FIG. 11, lateral force provided by the control assemblies is delivered to the load-bearing component 3 by means of tappet-like devices 36. The position of the tappet-like devices 36 is controlled by means of assorted rotatable cams 37. The rotational position of the cams 37 determines whether an associated disk spring assembly 35 is in a support position, wherein a pressing force is generated, or in a position in which the pressure applied to the load-bearing component 3 is relieved. Thus, each disk spring assembly 35 is supported, on one side, against a stop collar 38 associated with a tappet-like device 36. On its opposite side, each spring assembly 35 contacts a sliding sleeve 39 which carries a control roller 40. The sleeves 39 are guided in fixed position bearing-like mountings 41 and 42. The control rollers 40 are biased against cooperating cams 37 by the springs 35.

As shown in FIG. 11, before the pressing beam 6 starts to move, it is in a lowered position where it contacts the spine of the rounded book block 1, the book block being clamped between gripping jaws 8. At this time, the tappet-like devices 36 on either side are firmly in contact with the load-bearing component 3.

As shown in FIG. 12, after the pressing beam 6 has executed its working stroke in a first direction, and consequently has performed a backing operation, the load-bearing component 3 will be laterally supported only on one side, i.e., a laterally directed pressing force acting in one direction only will be imparting a pressing force for bending-over the printed sheets of the book block 1 in the side region of the spine. As indicated diagrammatically on FIG. 12, the cooperation between the force applied to the carrier 5 by actuating rod 7 and the resilient pressing force produced by the disk spring assembly will produce the lateral displacement which causes the superimposition of the tangential sliding motion on the swinging motion of the pressing beam.

Figure 13:
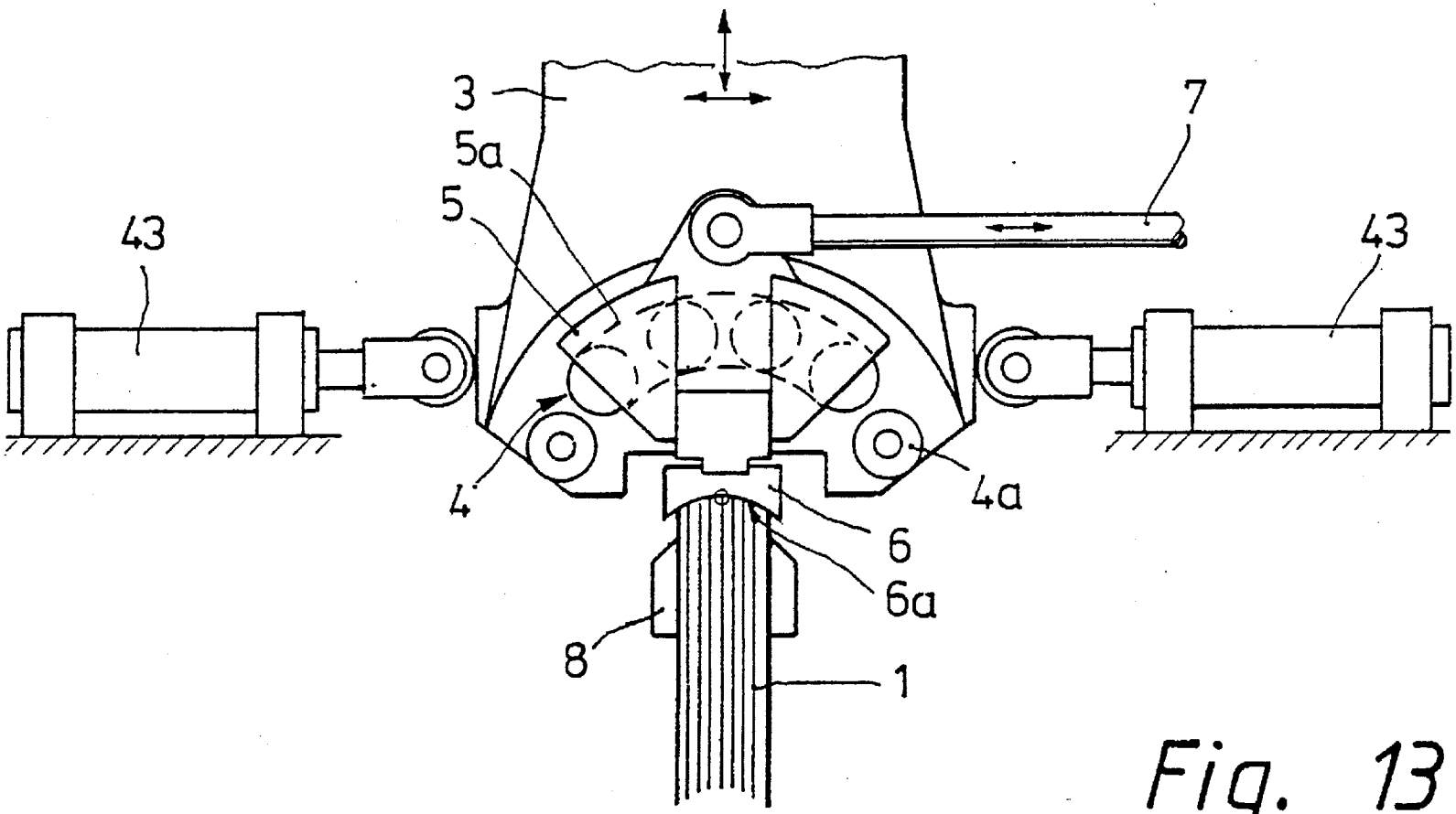
FIG. 13 is a view similar to FIG. 11 which depicts a modification of the sixth embodiment of the invention.

FIG. 13 constitutes a modification of the apparatus of FIGS. 11 and 12. In FIG. 13 fluidic actuators 43 are utilized in lieu of the mechanical control system of FIGS. 11 and 12. The use of pneumatic or hydraulic actuators permits the load-bearing component 3 to be moved between the positions shown in FIGS. 11 and 12, i.e,, a supporting position and a position in which the applied lateral force is relieved, by exercising control over a working fluid.

All of the above-described embodiments have the attribute that the backing operation may be performed by causing the pressing beam 6 to act a single time only on each side of the book block spine. Additionally, in lieu of the concave working surface **6*a*** employed in the embodiments described above, the present invention may be practiced using a pressing beam having either a convex or flat working surface.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In apparatus for backing book blocks by mechanical means, the book blocks having been rounded and being held in a clamped condition, the clamped book block having generally parallel sides and a convex spine region which extends between said sides, the center line of the spine region lying in a plane which is substantially parallel to said sides, the backing apparatus including a pressing beam having a contact surface which applies a compressive force to the spine of the book block, the backing apparatus further including a load-bearing component which supports a carrier on which the pressing beam is mounted, the carrier being movable relative to the load-bearing component to thereby impart swinging movements to the pressing beam, the improvement comprising:

means for displacing the center line of the contact surface of the pressing beam relative to the plane of the center line of the clamped book block during the swinging movements of the pressing beam to thereby generate tangential movements of the pressing beam which are superimposed on the swinging movements, the tangential movements being in directions which are generally away from said plane; and means for relieving the compressive force applied to the book block during movements of the pressing beam contact surface center line generally toward said plane.

2. The apparatus of claim 1 wherein said means for displacing comprises:

a rotationally driven control cam; and cam follower means for coupling said cam to the load-bearing component whereby the position of said load-bearing component will be controlled by the rotational position of said cam.

3. The apparatus of claim 2 wherein said cam follower means includes:

means for adjusting the magnitude of said displacement.

4. The apparatus of claim 1 wherein means for displacing comprises:

lever means connected to the carrier for causing the movement thereof to deviate from said arcuate path.

5. The apparatus of claim 4 wherein said lever means includes:

at least a first projection of the carrier; and a connecting rod coupling said first projection to a fixed point, the connection between said coupling rod and said first projection being located below a rotational center of the pressing beam.

6. The apparatus of claim 4 further comprising:

means for adjusting the effective length of said lever means to the carrier.

7. The apparatus of claim 5 further comprising:

means for varying the point of connection of said connecting rod to said first projection.

8. The apparatus of claim 1 wherein said means for displacing comprises:

means for causing the carrier to deviate from said arcuate path so as to follow a control path during the movement thereof.

9. The apparatus of claim 8 wherein said deviation causing means comprises:

a pair of fixed position control tracks which define said path;

control rollers supported from the carrier for cooperation with respective of said control tracks; and means for resiliently biasing the load-bearing component to a position where the pressing beam is centered on the book block spine, said biasing means generating a compressive force which assists in the bending over of the printed sheets of the book block in the side region of the book block spine as the movement of the carrier follows the control path.

10. The apparatus of claim 1 wherein the pressing beam has a concave working surface and wherein said means for displacing comprises:

means for translating lateral force applied to the load-bearing component into movement thereof along an arc-shaped path, the center of rotation of the radius of said arc-shaped movement path coinciding with the center of rotation of the radius of the working surface of the pressing beam, said radii being positioned below the axis of rotation of the arcuate path.

11. The apparatus of claim 10 wherein said means for translating includes:

means defining a pair of separate path segments; and means for adjusting the radii of said path segments.

12. The apparatus of claim 1 further comprising:

means for guiding vertical movements of the load-bearing component, said guiding means preventing lateral movement of the load-bearing component; and wherein said means for displacing comprises:

means mounting the pressing beam for movement relative to the carrier.

13. The apparatus of claim 12 wherein said mounting means comprises:

an intermediate carrier mounted on the carrier;

means for freely permitting limited movement of the pressing beam relative to said intermediate carrier.

14. The apparatus of claim 13 wherein said means permitting limited movement comprises:

means for selectively adjusting the maximum magnitude of the relative movement between the pressing beam and said intermediate carrier.

15. The apparatus of claim 13 wherein said means permitting limited movement comprises:

bearing means for supporting the pressing beam on said intermediate carrier; and spring means coupling the pressing beam to said intermediate carrier, said spring means biasing the pressing beam to a central position relative to said intermediate carrier.

16. The apparatus of claim 14 wherein said means permitting limited movement further comprises:

bearing means for supporting the pressing beam on said intermediate carrier; and spring means coupling the pressing beam to said intermediate carrier, said spring means biasing the pressing beam to a central position relative to said intermediate carrier.

17. The apparatus of claim 1 wherein said means for displacing comprises:

means laterally supporting the load-bearing component at a pair of opposite sides thereof, said lateral supporting means each producing a pressing force directed toward the plane of the center line of the book block; and control means for relieving said pressing force.

18. The apparatus of claim 17 wherein said supporting means comprises:

tappet means for contacting the load-bearing component, said tappet means including a reciprocally movable actuating rod;

spring means for resiliently biasing said tappet means in the direction of the load bearing component; and wherein said control means comprises:

means for selectively applying a compressive force to said spring means.

19. The apparatus of claim 18 wherein said spring means comprises:

a disk spring assembly, said assembly having a pair of opposite ends;

a stop collar mounted on said actuating rod in contact with a first end of said disk spring assembly; and a sleeve slidably mounted on said actuating rod, said sleeve contacting said spring assembly second end; and wherein said control means further comprises:

cam means for selectively imparting movement to said sleeve relative to said disk spring assembly.

20. The apparatus of claim 17 wherein said supporting means comprises:

tappet means for contacting the load-bearing component, said tappet means including a reciprocally movable actuating rod; and wherein said control means comprises:

fluidic actuator means for selectively causing said tappet means to apply a compressive force to the load bearing component.

21. The apparatus of claim 1 wherein said means for displacing comprises:

guide means for laterally engaging the load-bearing component, said guide means producing a pressing force directed toward the plane of the center line of the book block in reaction to swinging movement of the carrier away from said plane.

22. The apparatus of claim 21 wherein said control means comprises:

fluidic actuator means.

23. The apparatus of claim 1 wherein the compressive force is applied to the load-bearing member in a direction generally parallel to said plane, and wherein said means for relieving comprises:

means for causing the pressing beam to move in a direction in opposition to the applied compressive force during movement thereof generally in the direction of said plane.

24. The apparatus of claim 1 wherein the center of rotation of the pressing beam can be adjusted to a position above the book block spine.

25. The apparatus of claim 1 wherein said means for displacing produces movement of the load-bearing component, the produced movement having a component which is lateral with respect to said plane.

26. A method for backing a book block comprising the steps of:

clamping the book block between a pair of oppositely disposed gripping jaws, the clamped book block having a center line which lies in a plane intermediate and parallel to planes defined by the working surfaces of the clamping jaws;

bringing a pressing beam into contact with the spine of the book block, the pressing beam having a contact surface with a center point which contacts the book block in the region of the center line thereof;

applying a compressive force to the pressing beam;

causing the contact surface of the pressing beam to execute a swinging movement about the point of contact between the center point of the contact surface and the center line of the book block spine in a first direction, to then execute a return stroke to its initial orientation relative to the book block spine and thereafter to execute a swinging movement about the point of contact between the center point of the contact surface and the center line of the book block spine in a second direction opposite to said first direction;

imposing a force on the pressing beam which causes the center point of the contact surface thereof to move generally tangentially with respect to the path of the swinging movements thereof during portions of such swinging movements whereby a tangential sliding movement is superimposed on the swinging movements at least in the edge regions of the book block spine; and relieving the applied compressive force during said return stroke.

27. The method of claim 26 wherein the backing operation consists of causing the pressing beam to execute a single pass wherein the tangential sliding motion is superimposed on the swinging motion in each direction from the center line of the book block spine toward each side edge of the book block spine.

* * * * *